US005851169A

United States Patent [19]

Meresz et al.

[11] Patent Number: 5,851,169

[45] Date of Patent: Dec. 22, 1998

[54] ROTARY PLATE AND BOWL CLAMP FOR BLOOD CENTRIFUGE

[75] Inventors: Henry Meresz, Coloma, Wis.; Wayne P. Griffin, Cranberry Township, Pa.; Clark M. Hill, Denver, Colo.; Richard Matt, San Jose, Calif.

[73] Assignee: Medtronic Electromedics, Inc., Parker, Colo.

[21] Appl. No.: 790,076

[22] Filed: Jan. 28, 1997

Related U.S. Application Data

[60] Provisional application No. 60/010,944 Jan. 31, 1996.

[51] Int. Cl.[6] ..... B04B 7/06

[52] U.S. Cl. ..... 494/12; 279/43.5; 279/140; 279/158

[58] Field of Search ..... 494/12, 41, 43, 494/84, 85; 279/43.1, 43.2, 43.4, 43.5, 110, 133, 140, 158

[56] References Cited

U.S. PATENT DOCUMENTS

| | | | |
|---|---|---|---|
| 3,317,127 | 5/1967 | Cole . | |
| 3,581,981 | 6/1971 | Latham, Jr. . | |
| 3,706,412 | 12/1972 | Latham, Jr. . | |
| 3,785,549 | 1/1974 | Latham, Jr. . | |
| 4,086,924 | 5/1978 | Latham, Jr. . | |
| 4,668,214 | 5/1987 | Reeder . | |
| 4,684,361 | 8/1987 | Feldman et al. | 494/41 |
| 4,692,136 | 9/1987 | Feldman et al. | 494/38 |
| 4,718,888 | 1/1988 | Darnell | 494/85 |
| 4,795,419 | 1/1989 | Yawn | 494/84 |
| 4,838,849 | 6/1989 | Calari | 494/12 |
| 5,062,826 | 11/1991 | Mantovani et al. | 494/85 |
| 5,158,407 | 10/1992 | Zettl | 279/43.5 |
| 5,591,113 | 1/1997 | Darnell et al. | 494/12 |
| 5,658,231 | 8/1997 | Schmitt et al. | 494/12 |

*Primary Examiner*—Charles E. Cooley
*Attorney, Agent, or Firm*—Ancel W. Lewis, Jr.

[57] ABSTRACT

A system for securing a blood separator bowl in an autotransfusion machine includes a split ring or collar adapted to grip an enlarged cap on the base of the bowl and a clamp assembly for moving the collar between retracted and expanded positions. In the retracted position, the clamp assembly includes both an overcenter lock system for securing the collar in the retracted position and a backup auxiliary lock in the event of failure. The system further provides for centering the separator bowl on its axis of rotation to prevent undue vibration.

17 Claims, 8 Drawing Sheets

ROTARY PLATE AND BOWL CLAMP FOR BLOOD CENTRIFUGE

This application claims the benefit under 35 U.S.C. §119(e) of the U.S. provisional patent application No. 60/010,944 filed Jan. 31, 1996.

BACKGROUND OF THE INVENTION

1. Field of the Invention

This invention relates generally to equipment for blood transfusions or reinfusions and more particularly to a clamp for securing a centrifugal separator bowl within an autotransfusion machine.

2. Description of the Prior Art

Whole human blood includes at least three types of specialized cells. These are the red blood cells, white blood cells and platelets. All of these cells are suspended in plasma, a complex aqueous solution of proteins and other chemicals.

When removing blood from a donor for homologous transfusion, for reinfusion or when obtaining blood for plasmapheresis, and/or salvaging blood from a body, cavity or a wound site, it is important to remove the undesirable elements from the blood before reinfusing or transfusing the blood into a patient. The undesirable elements that must be removed include plasma, activated clotting factors and/or byproducts of coagulation, drugs, cellular debris, platelets and leukocytes, otherwise referred to as white blood cells. The only element of the blood which remains after the removal of the undesirable elements are the red blood cells, which are the desired element for reinfusion or transfusion.

Numerous systems have been developed for cleaning whole blood by removing the undesirable elements, examples of which are disclosed in U.S. Pat. No. 4,086,924 issued to Latham, Jr. and U.S. Pat. No. 4,668,214 issued to Reeder which is of common ownership with the present application. These systems include means for removing the blood from a patient, adding an anticoagulant to the blood, separating the various components of the blood usually in a centrifugal separator, washing the desirable red blood cell component which is retained in the separator with a saline solution, and then reinfusing the clean red blood cell into the patient from whom the blood was drawn or transfusing the blood into a donor patient.

The separation and washing process, as mentioned above, is normally accomplished in a centrifugal separator commonly referred to as an autotransfusion machine, wherein the whole blood, including the anticoagulant, is introduced through a central column of a rotating centrifugal separator bowl so that the blood will flow to the outer edge of the bowl and subsequently upwardly along a circumferential wall of the bowl until the lighter elements are discharged through an outlet provided near the top of the bowl. The red blood cells being the heaviest component of whole blood remain in the bowl for the longest period of time so that the lighter undesirable elements are discharged before the red blood cells fill the separating bowl. Once the bowl is substantially full of red blood cells, the cells have become compacted against the circumferential wall of the bowl and portions of the plasma remain trapped in the interstitial spaces between the red blood cells. In order to remove the plasma from the spaces between the red blood cells, it has been common practice to pass a saline solution through the centrifugal separator to wash the plasma out of the interstitial spaces between the cells.

It will be apparent that the separator bowl must be securely mounted in a centered position on a rotating plate within the autotransfusion machine to minimize vibration and breakage of the bowl. Separator bowls are generally bell-shaped in configuration having an enlarged peripheral cap around the lower edge which facilitates attachment of the bowl to the rotating plate which in turn selectively drives and rotates the bowl. The top of the bowl has a centrally disposed shaft which is also secured within the autotransfusion machine with the shaft being rotatably mounted within a bearing at an upper end of the bowl. The shaft, accordingly, remains stationery while the body of the bowl rotates.

The present invention was developed to provide a new and improved system for positively securing the bowl within the autotransfusion machine and in a manner such that vibration is minimized, breakage of the bowl is eliminated and the bowl can be quickly and easily inserted into or removed from the autotransfusion machine.

SUMMARY OF THE INVENTION

The present invention relates to an improved clamping system for reliably securing a centrifugal separator bowl in an autotransfusion machine such that it cannot be dislodged during operation and in a manner such that the bowl is quickly secured within or released from the machine.

The clamping system includes a split ring or collar adapted to releasably grip the annular cap on the bottom of a separator bowl. The collar is made of a spring metal and has a pair of normally spaced ends which can be moved against the bias of the spring metal into closely adjacent relationship. By moving the ends of the collar the effective circumference of the collar is regulated to selectively grip or release the cap around the base of the separator bowl.

The collar is secured on a rotating base plate with a bowl support plate in a manner such that retraction of the collar, as when gripping the bowl, causes the collar to cooperate with the bowl support plate to center the collar relative to the rotating axis of the base plate and to center the bowl within the collar.

A clamp mechanism is also mounted on the base plate so as to cooperate with the ends of the collar in moving them toward or away from each other so as to retract or expand the effective circumference of the collar. The clamp mechanism includes an inverted u-shaped main body that cooperates with a pair of pivot arms which are in turn connected to the ends of the collar such that reciprocal vertical sliding movement of the main body moves the ends of the collar toward or away from each other as desired. The pivot arms are positioned so as to establish an overcenter lock to secure the ends of the collar in closely adjacent relationship when it is desired to clamp a separator bowl within the system and the main body is adapted to override the overcenter lock to allow the ends of the ring to be separated when it is desired to release the separator bowl from the system.

An auxiliary lock is also provided on the clamp which is urged into a locking position by centrifugal force with the auxiliary lock establishing a bridge between the pivot arms preventing the pivot arms from being moved out of a locking position when the system is rotating.

Other aspects, features and details of the present invention can be more completely understood by reference to the following detailed description of a preferred embodiment taken in conjunction with the drawings and from the appended claims.

DESCRIPTION OF THE PREFERRED EMBODIMENT

Figure 1:
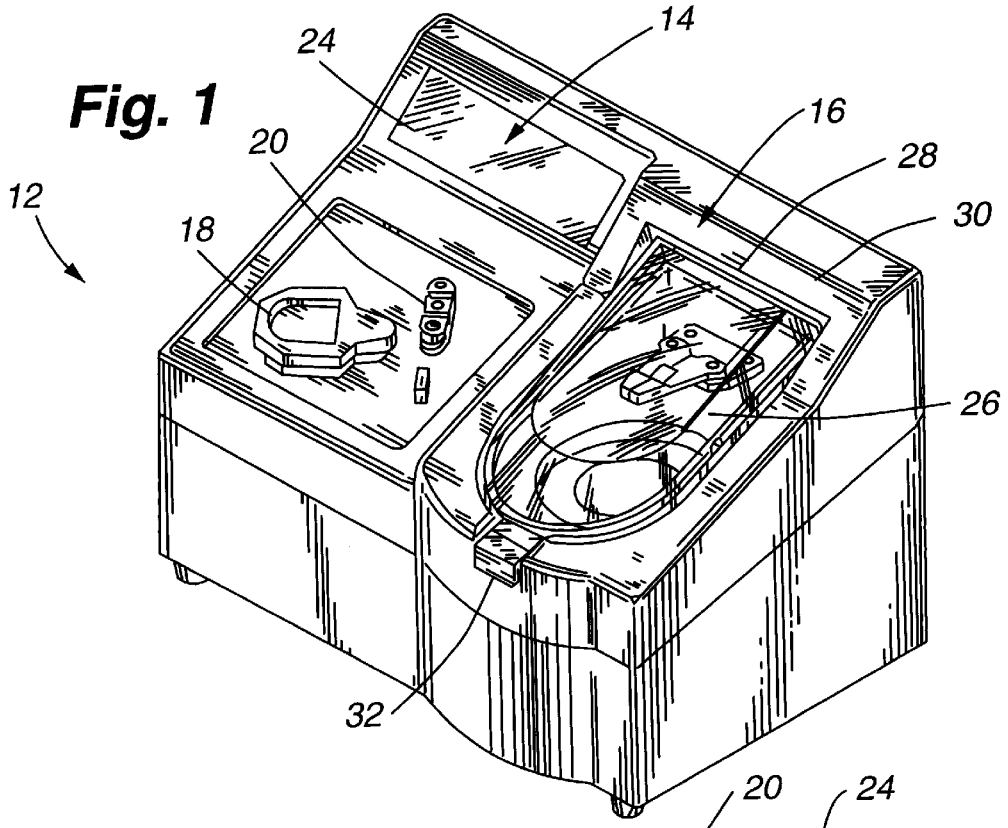
FIG. 1 is an isometric view of an autotransfusion machine incorporating the separator bowl clamping system of the present invention.
Figure 2:
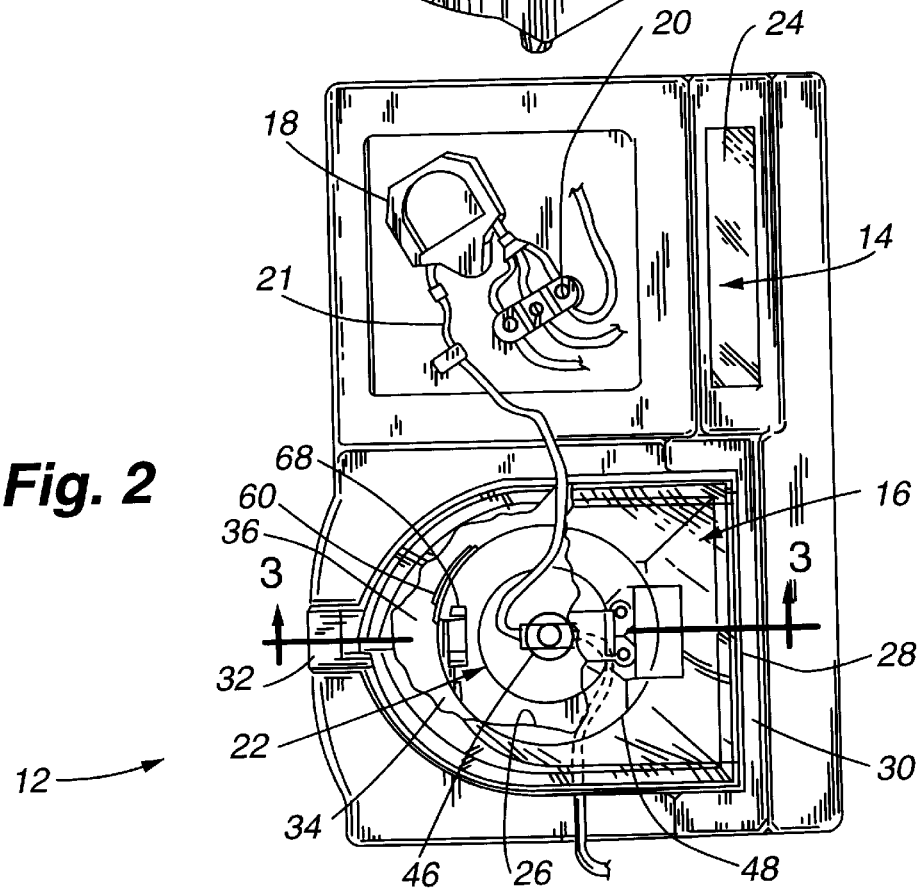
FIG. 2 is a top plan view of the machine shown in FIG. 1.

FIG. 1 shows an autotransfusion machine 12 having a left portion 14 and a right portion 16. The left portion includes a pump 18 and valve means 20 for selectively delivering blood through tubing 21 to a separator bowl 22 (FIG. 3) on the right portion 16 of the machine. A control panel 24 utilizing touch screen capability is also positioned on the left portion 14 and controls electronic circuitry (not shown) within the machine for operating the various components of the machine. In operation, the pump 18 selectively delivers and removes blood or components thereof from the separator bowl 22 through use of the valves 20 that are electronically controlled. The sequence of operation may be of the type described in U.S. Pat. No. 4,668,214 to Reeder, which is hereby incorporated by reference, even though the machine can be operated, with predesigned circuitry, in accordance with any desirable procedure known to those in the art.

The right portion 16 of the machine, where the separator bowl 22 is mounted, includes a clear cover 26 pivoted along a back edge 28 to the shell 30 of the machine. The cover is selectively clamped in the closed position of FIG. 1 by a latch 32 on the shell at the front edge of the cover. When the machine is being operated, the cover is always latched in the closed position but to insert or remove a separator bowl from a cavity 34 defined in the right portion of the machine, the clear cover is unlatched at the forward edge and pivoted about the rear edge into an open position.

Figure 3:
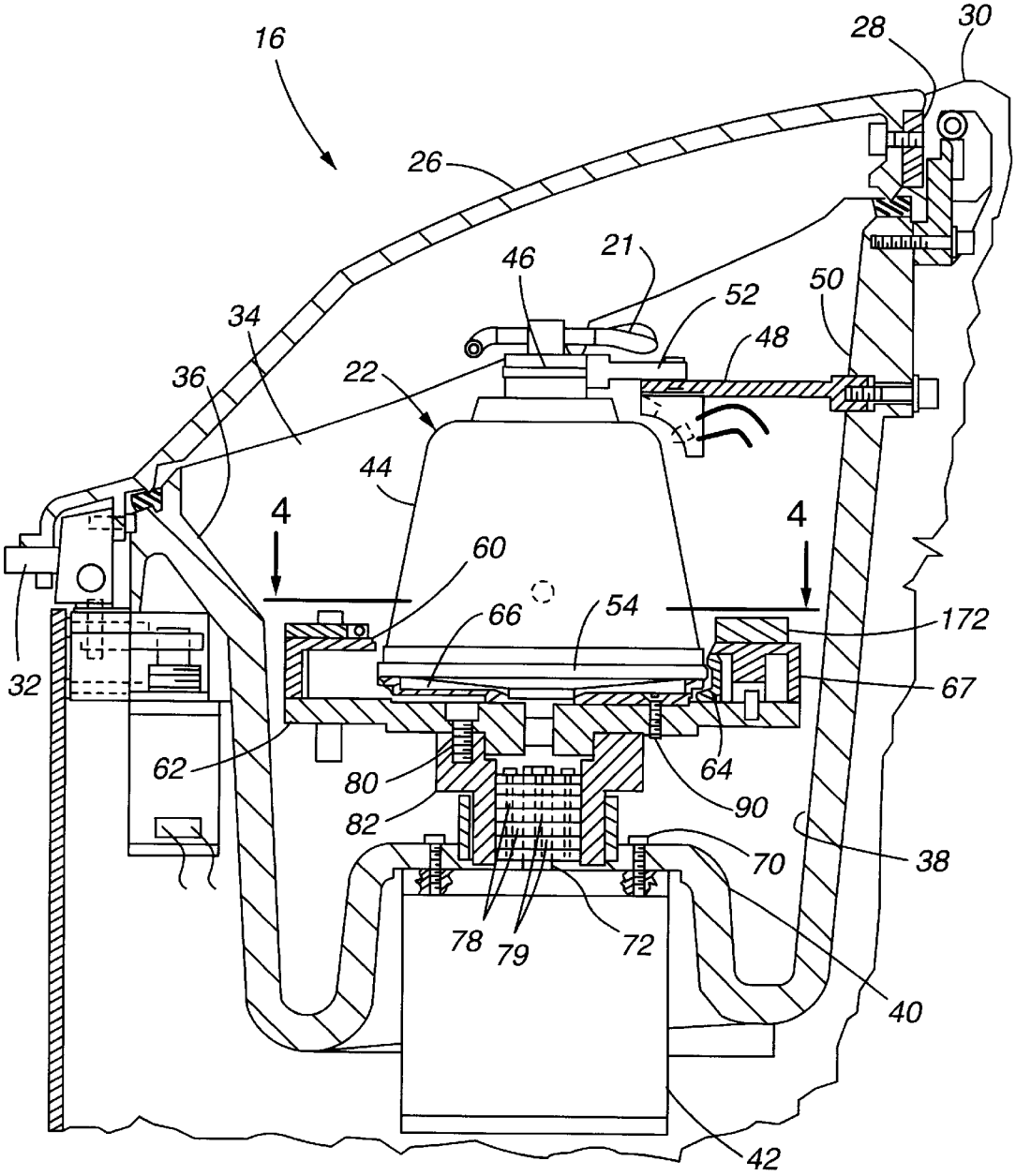
FIG. 3 is an enlarged fragmentary section taken along line 3—3 of FIG. 2.
Figure 4:
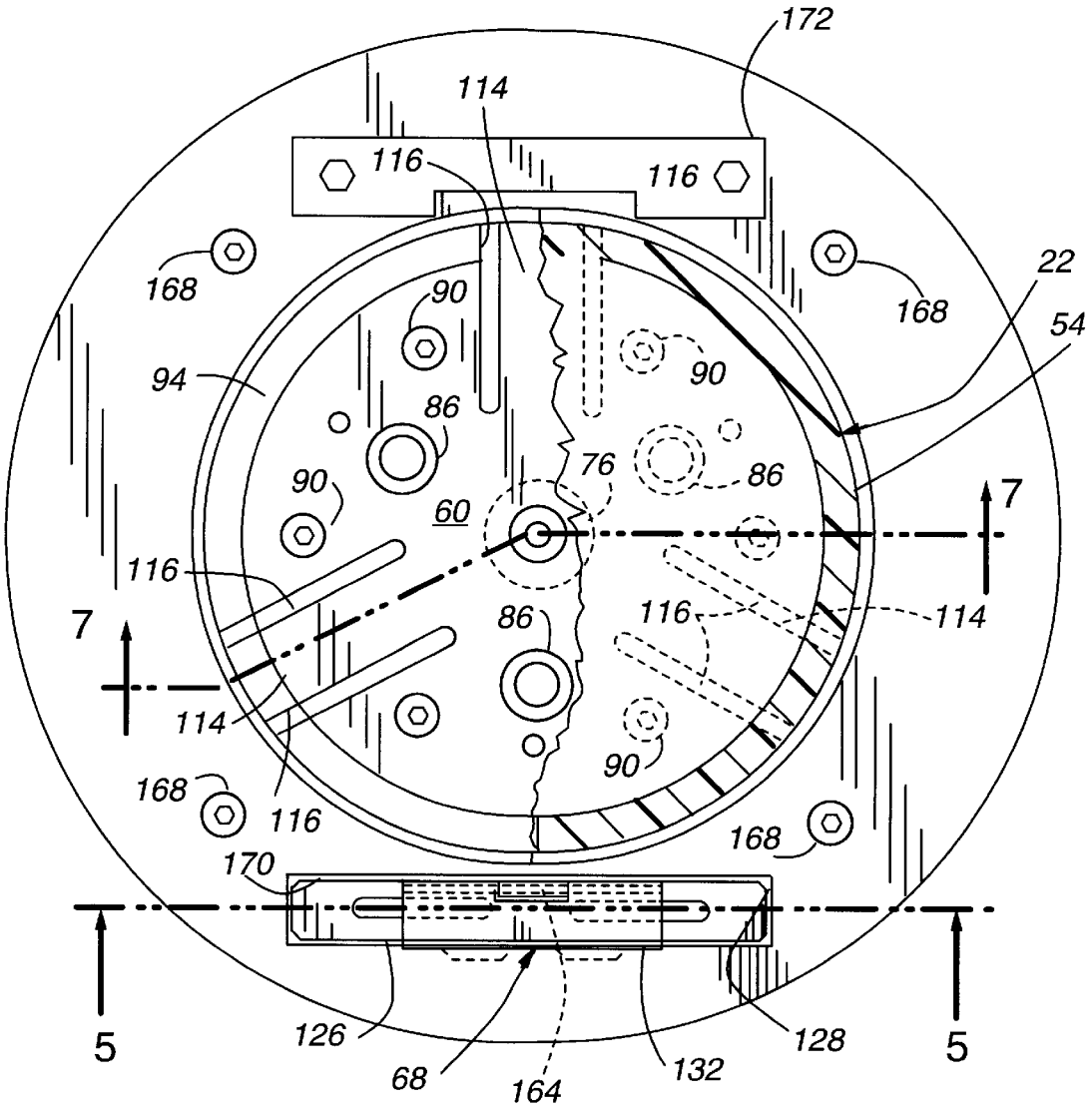
FIG. 4 is a further enlarged fragmentary section taken along line 4—4 of FIG. 3.

As best seen in FIG. 3, the right portion 16 of the machine includes a well 36 having a circular peripheral bottom wall 38 and a raised center hub 40 to which an electric motor 42 is secured underneath. The peripheral bottom wall may have a drain hole (not shown) in communication therewith to drain fluids that may accumulate or result from an accident wherein fluids within the separator bowl are released into the well.

The separator bowl 22 as best seen in FIG. 3, includes a generally bell-shaped main body 44 of substantially hollow construction with a bearing 46 disposed in the top of the body that rotatably receives a shaft (not seen) to which a stabilizing arm 48 can be releasably connected. The stabilizing arm is anchored to a rear wall 50 of the well 36 and has a conventional mechanism 52 for gripping the shaft so that the main body of the separator bowl can be rotated about the shaft. The basic components of the bowl 22 as well as the tubing 21 for delivering blood to and removing blood or its components from the bowl are well known in the art. An example would be a bowl of the type currently sold and marketed by the assignee of the present application under Model BT225E.

Figure 9:
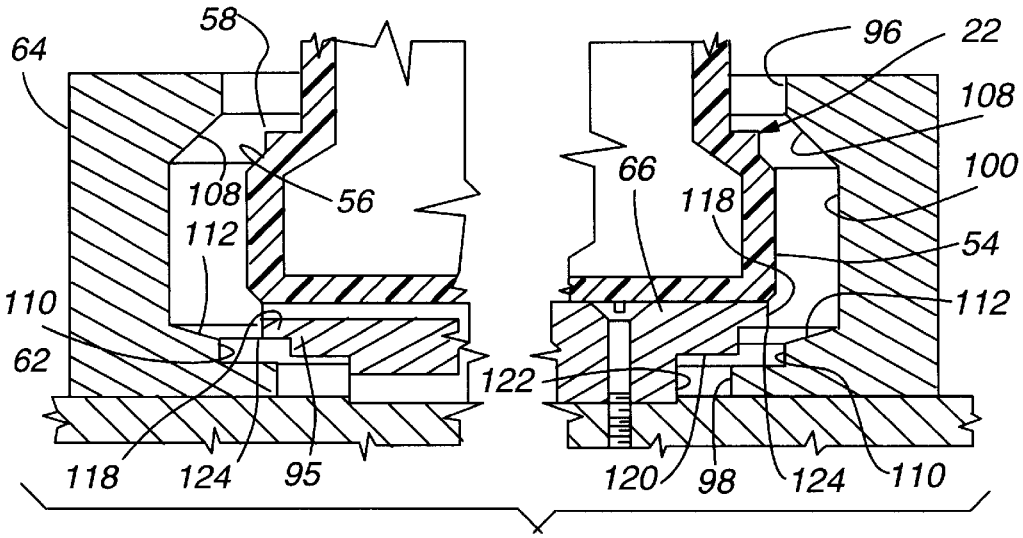
FIG. 9 is a fragmentary section similar to FIGS. 7 and 8 showing the collar in an open position from which the separator bowl can be removed from the machine.
Figure 8:
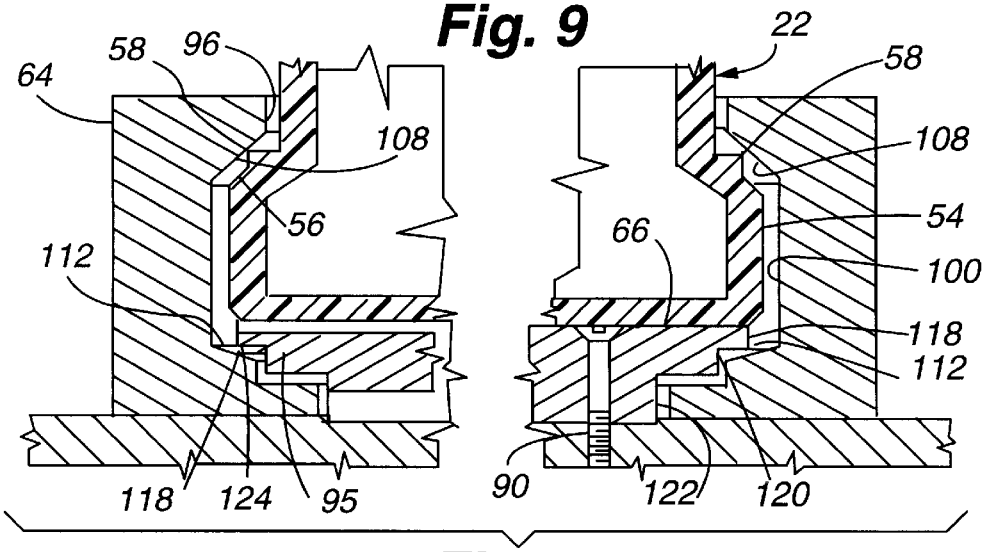
FIG. 8 is a fragmentary section similar to FIG. 7 with the collar being slightly loosened relative to its position in FIG. 7.
Figure 7:
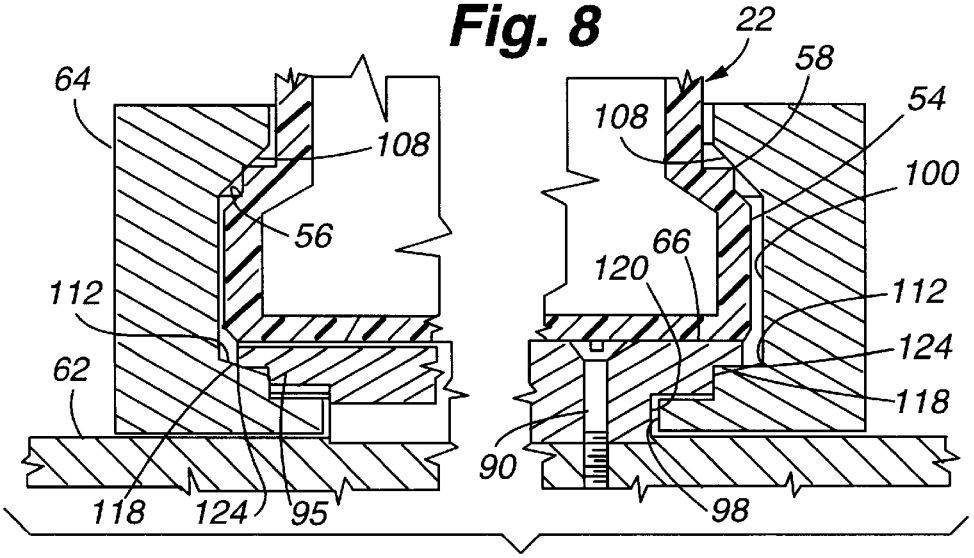
FIG. 7 is a enlarged fragmentary section taken along line 7—7 of FIG. 4 with the bowl being clamped by the collar in the machine.

The bottom edge of the bowl, however, for purposes of cooperation with the clamping system of the present invention has been modified from conventional bowls of the type identified above, and includes a lower cap 54 that defines an enlarged circumferential protrusion at the base of the bowl. The cap 54 is designed to accommodate the gripping thereof by the clamping system of the present invention. As best seen in FIGS. 7, 8 and 9, the cap is of generally shallow cylindrical configuration having a beveled upper surface 56 with an outwardly protruding circumferential rim that defines a relatively sharp circular edge 58. This edge, as will become more apparent later, provides a mechanism by which the bowl 22 can be centered within the well 36 for vibration free rotation.

Figure 10:
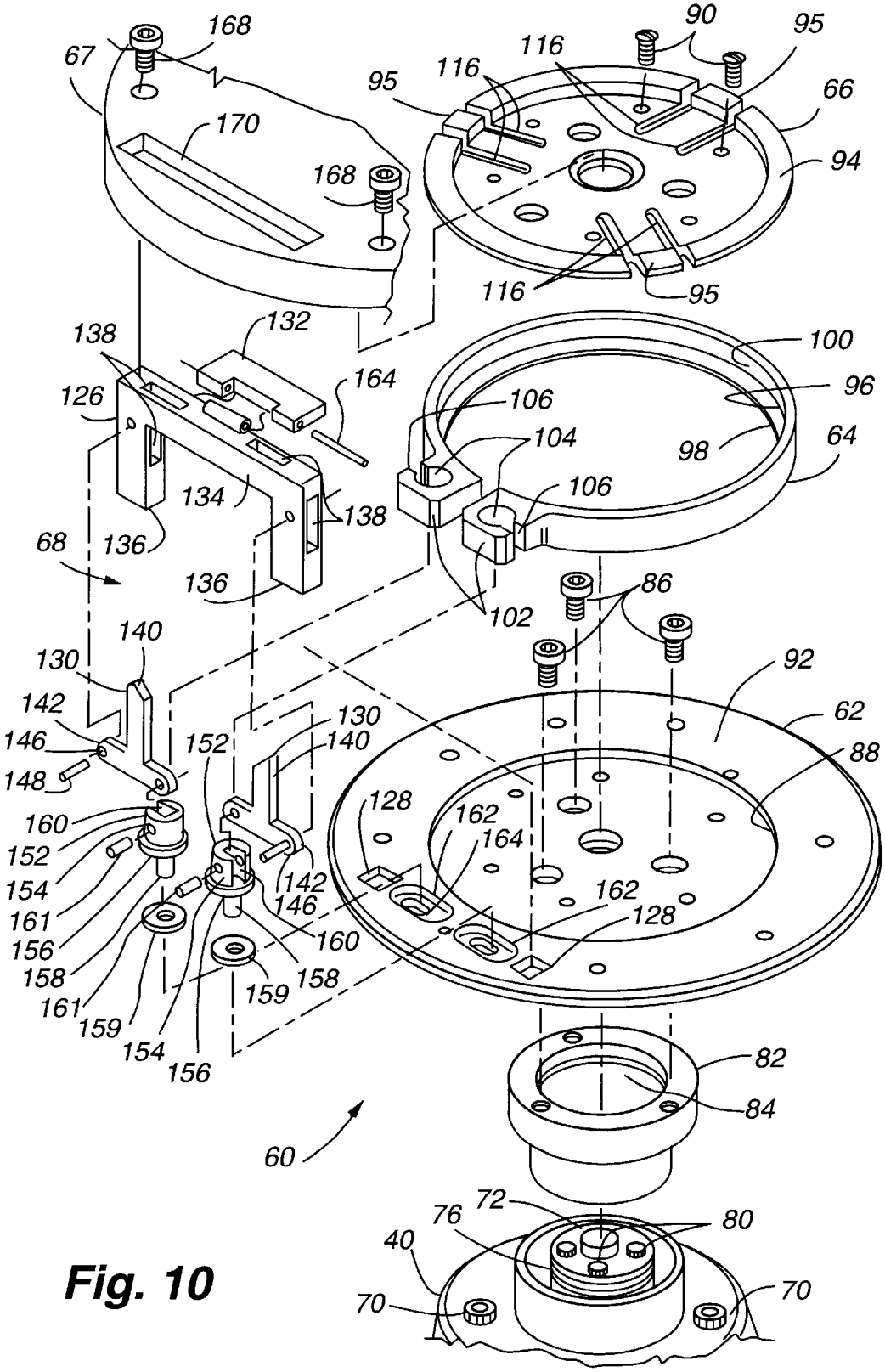
FIG. 10 is a fragmentary exploded isometric showing the various components of the system for securing or clamping a separator bowl in the machine of FIG. 1.
Figure 11:
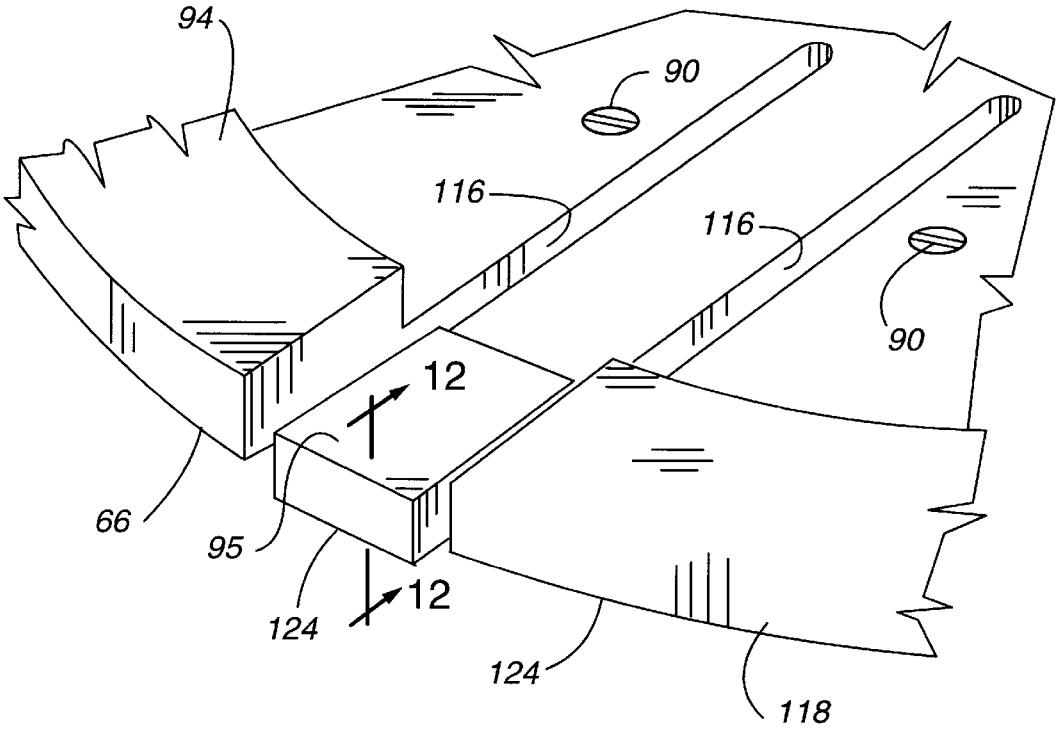
FIG. 11 is an enlarged fragmentary isometric of a portion of the bowl support plate illustrating the relation of a tine form therein relative to the remainder of the plate.
Figure 12:
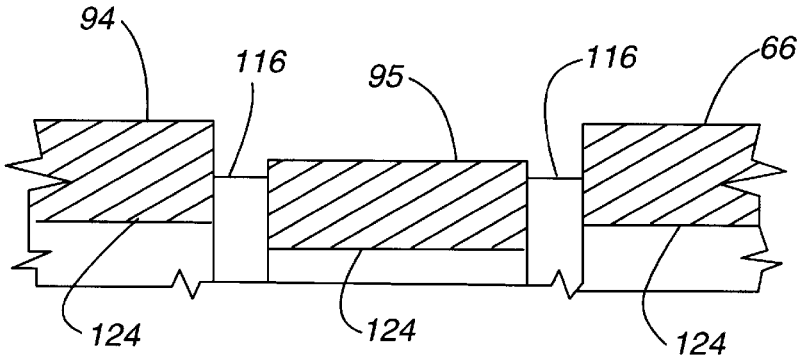
FIG. 12 is a fragmentary section taken along line 12—12 of FIG. 11.

The bowl clamping system 60 of the present invention is probably best seen in FIGS. 3 and 10 to include a disk-shaped rotating or base plate 62, a split ring or collar 64 loosely seated on the base plate, a bowl support plate 66 positioned within the collar and adapted to secure the collar to the base plate, a housing 67 around the collar and a clamp assembly 68 for selectively securing the cap 54 of the separator bowl 22 within the collar 64. The entire clamping system is rotated by the electric motor 42 mounted beneath the hub 40 of the well 36. The motor is secured to the hub by fasteners 70 such that the driveshaft 72 of the motor projects upwardly through a circular opening 74 in the hub. The driveshaft 72, as seen in FIG. 3, is operatively received within an expansive-type coupler 76 which is of conventional design. The coupler includes alternating metal 78 and rubber 79 rings which are compressed together by four axially extending fasteners 80 that extend down through holes in the various rings of the coupler while being threadedly received in the lowermost metal ring 78. It will be appreciated that when the fasteners 80 are tightened, the metal rings 78 compress the rubber rings 79 therebetween causing the rubber rings to expand radially inwardly and outwardly. The radially inward expansion causes the coupler 76 to grip the driveshaft 72 of the motor.

The coupler 76 is positioned within a driven collar 82 which has an internal diameter approximating that of the outer diameter of the coupler such that the radially outward expansion of the coupler causes the rubber rings 79 to grip the inner wall 84 of the driven collar. In this manner, the driven collar can be selectively rotated by the electric motor 42 in any given sequence or speed through the coupler which couples the motor driveshaft to the driven collar.

The driven collar 82, as seen in FIGS. 3 and 10, is in turn secured to the underside of the base plate 62 with three circumferentially spaced fasteners 86 so that the base plate rotates in unison with the driven collar about the rotational axis of the driveshaft 72. The base plate has a central depressed circular region 88 in which the bowl support plate 66 is positively secured with three pair of circumferentially spaced fasteners 90.

Before securing the bowl support plate 66 to the base plate 62, however, the split ring or collar 64 is positioned on the raised outer ring-like circumference 92 of the base plate (FIG. 3). The bowl support plate has an interrupted raised radially directed peripheral lip 94 around its circumference adapted to support a separator bowl 22 and three circumferentially spaced tines 95 adapted to cooperate with the collar in a manner to be described hereafter to secure the collar to the base plate.

The collar 64, as best seen in FIGS. 7 through 9, is of generally split-ring configuration having upper and lower radially inwardly directed circumferential lips 96 and 98 respectively defining a channel 100 therebetween adapted to receive the cap 54 of the separator bowl. The collar 64 also has two enlarged ends defining blocks 102 (FIG. 10), each with a vertical cylindrical passage 104 therethrough. A lateral slot 106 in each block communicates with the cylindrical passage for a purpose to be described later.

The collar 64 is made of spring metal, such as aluminum or steel, and assumes a normal at-rest position as illustrated in FIG. 10 wherein the block ends 102 are spaced a predetermined distance. The block ends can be moved toward each other against the bias of the collar thereby reducing the effective circumference of the collar. The maximum effective circumference of the collar, as shown in FIG. 10, with the collar in its normal or at rest position, is sufficient to allow the cap 54 of the separator bowl to be inserted therein while the retracted or reduced effective circumference obtained by moving the ends of the collar toward each other is comparable to the circumference of the cap. In this manner the cap can be encaptured within the channel 100 of the collar when securing the bowl to the autotransfusion machine 12 as seen in FIG. 3.

The upper circumferential lip 96 of the collar 64 defines a first or upper beveled surface 108, and the lower lip 98 defines a shoulder 110 as well as a second beveled surface 112 as is best seen in FIG. 7 through 9. As will be appreciated with the description that follows, the beveled surfaces 108 and 112 on the collar cooperate with the bowl support plate 66 and the separator bowl 22 in centering the collar relative to the motor drive shaft 72 and securing it to the bowl support plate 66 as well as centering the bowl relative to the driveshaft to prevent vibrations.

With reference to FIGS. 4 and 7–10, it will be appreciated that the three equally circumferentially spaced tines 95 are defined between parallel radial slots 116 formed in the bowl support plate. While the bowl support plate is made of a rigid metal, the tines, due to their relatively narrow width, have a slight degree of flexibility relative to the remainder of the plate and are disposed slightly lower than the remainder of the plate as shown in FIGS. 7 through 9, 11 and 12. The elevated peripheral lip 94 of the bowl support plate is stepped in cross-section, as best seen in FIGS. 7 through 9, so as to define a large diameter upper region 118 with an outer, lower edge 124 an intermediate, diameter middle region 120 and a small diameter lower region 122. The lower edge 124 of the upper region 118 on each tine is aligned with the lower beveled surface 112 on the collar so as to operatively cooperate therewith in a manner to be described later.

The sharp ring-like edge 58 on the cap 54 of the separator bowl 22, as best seen in FIGS. 7 through 9, is aligned with the upper beveled surface 108 on the collar for operative cooperation therewith when the bowl is seated on the bowl support plate 66. When securing the separator bowl to the autotransfusion machine 12, the bowl is first positioned within the collar 64 with the block ends 102 of the collar in the separated at rest positions and with the bowl seated upon the elevated lip 94 of the bowl support plate 66. This positioning is illustrated in FIG. 9. As the block ends of the collar are moved toward each other thereby retracting the collar against its natural spring bias, the channel 100 within the collar is moved toward the cap of the separator bowl as well as the bowl support plate until the upper beveled surface 108 of the collar engages the sharp ring-like edge 58 on the bowl cap and the lower circumferential edge 124 of the upper region 118 of each tine 95 on the bowl support plate engages the lower beveled surface 112 on the collar as shown in FIG. 8. Continued retraction of the collar further reduces the effective circumference of the collar causing the lower edge 124 of the upper region 118 of each tine 95 to slide slightly up the lower beveled surface 112 of the collar. The spring bias in each tine as cams or yieldingly urges the collar 64 downwardly thereby gripping the lower lip 98 of the collar between the bowl support plate 66 and the base plate 62. This camming of the collar downwardly positively secures the collar relative to the base plate and the bowl support plate but also centers the collar relative to the axis of rotation of the base plate and bowl support plate to evenly distribute the weight of these components about the axis of rotation. It should be appreciated that only the tines 95 on the bowl support plate engage the collar since they are disposed lower than the remainder of the bowl support plate.

Simultaneously with the camming of the collar downwardly as illustrated in FIG. 7, the bowl 22 becomes centered within the collar 64 due to the engagement of the sharp circular edge 58 of the bowl riding along the upper beveled surface 108 which in turn urges the separator bowl downwardly into tight engagement with the bowl support plate 66.

As will be appreciated, when the collar 64 is retracted, or reduced in effective circumference, not only is the separator bowl 22 centered and positively gripped by the collar so that the bowl will move in unison with the bowl support plate 66, but the collar itself is centered relative to the bowl support plate so that the mass of the rotating components are substantially evenly distributed about the axis of rotation to minimize vibration during operation of the machine.

The clamp assembly 68 for selectively moving the collar 64 between the expanded and retracted positions is probably best seen in FIG. 10 to include a main body 126 that is slidably disposed within square openings 128 in the base plate and a pair of levers or pivot arms 130 that are operatively connected to the main body and to the ends of the collar such that sliding vertical movement of the main body in the square openings 128 affects movement of the block ends 102 of the collar toward and away from each other. The clamp assembly further includes an auxiliary lock plate 132 pivotally mounted on the main body 126 which functions as a safety lock in assuring that the collar remains in a retracted position during operation of the autotransfusion machine 12.

Figure 5:
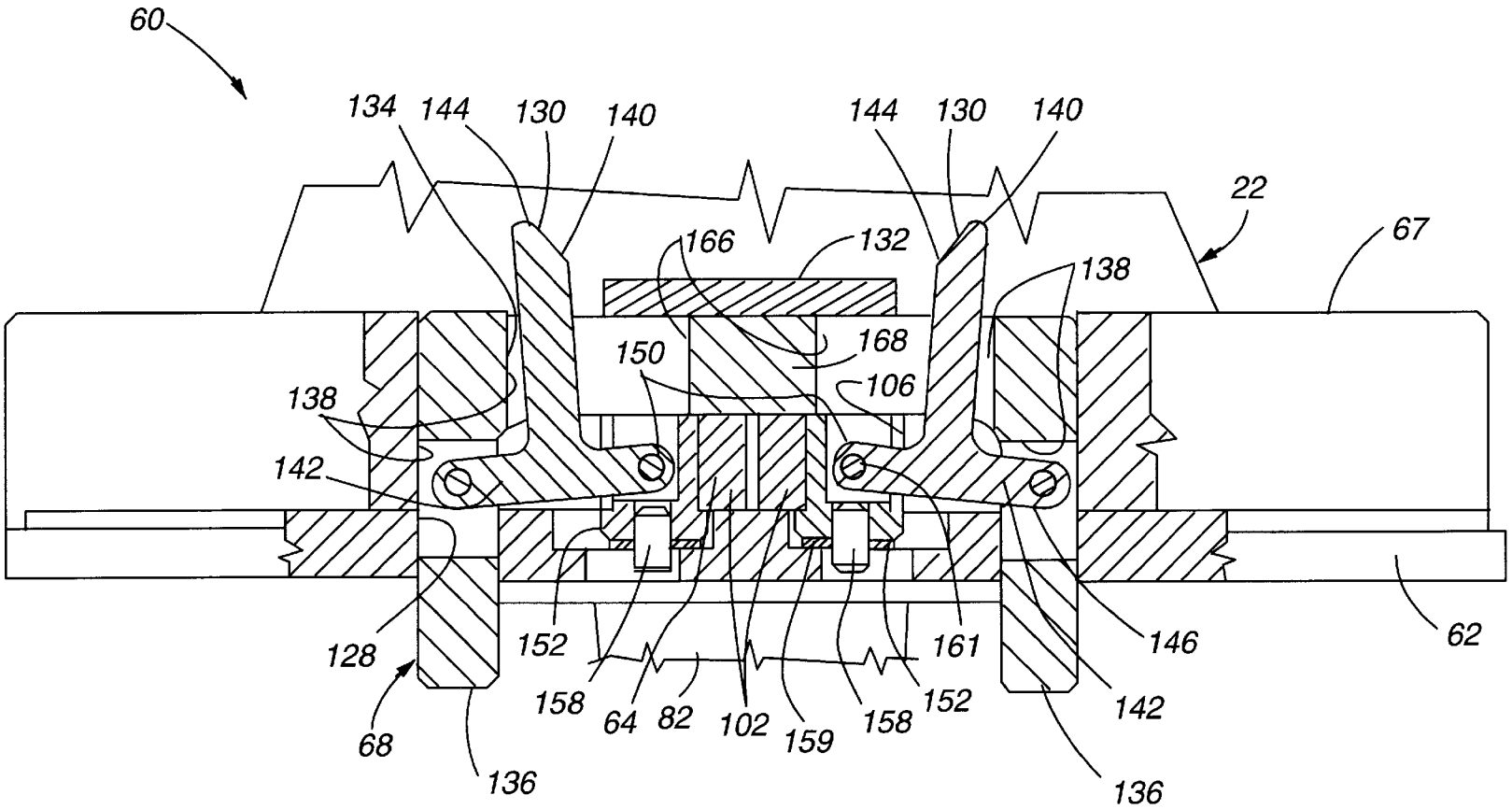
FIG. 5 is a section taken along line 5—5 of FIG. 4 showing the pivot arms in a locking position.
Figure 6:
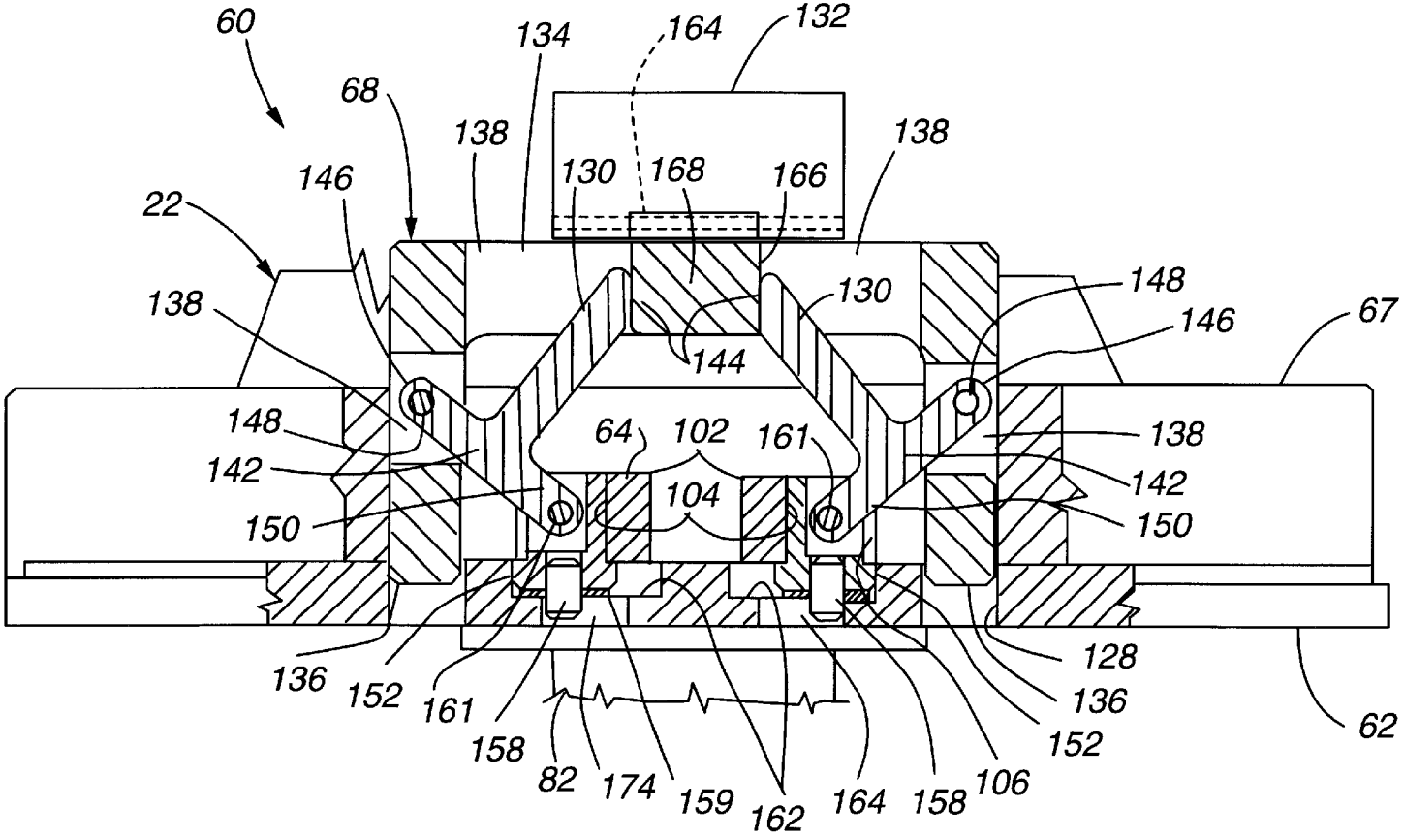
FIG. 6 is a section similar to FIG. 5 showing the pivot arms in an unlocked position.

With particular reference to FIGS. 5, 6 and 10, the main body 126 can be seen to be of generally inverted U-shaped configuration, of substantially square cross-section and defines an upper horizontal leg 134 and a pair of depending legs 136. The depending legs are adapted to slide vertically within the square openings 128 provided in the base plate 62 adjacent the perimeter thereof. Both the horizontal leg 134 and the depending legs 136 have slots 138 therethrough to accommodate positioning and movement of the pivot arms 130. The pivot arms are of inverted T-shaped configuration and define a main arm 140 and a cross arm 142 with the cross arm forming a perpendicular extension from the base of the main arm. The upper free end of the main arm has a beveled surface 144 for a purpose to be described later.

The outer end 146 of each cross arm 142 is pivotally connected with a pivot pin 148 to an associated depending leg 136 of the main body within the slot 138 formed in the depending leg. The inner end 150 of each cross arm is pivotally connected to a connector cylinder 152 (FIGS. 5, 6 and 10) that is secured to the collar. The connector cylinders have a relatively large upper cylindrical body 154, a further enlarged intermediate disk 156 and a relatively small depending guide pin 158. Each cylindrical body 154 of the connector cylinder is friction fit or otherwise secured within the cylindrical passage 104 on an end block 102 at one end of the collar and has a slot 160 formed therein that is aligned with the slot 106 in the associated end block. A pivot pin 161 in the slot 160 pivotally connects the connector cylinder to the cross arm 142.

The intermediate disk 156 of the connector cylinder is slidably seated on a thrust washer 159 within a substantially ovular recess 162 formed in the upper surface of the base plate 62 adjacent to one of the square openings 128. There are, of course, two ovular recesses 162 and they are positioned side-by-side between, and in alignment with, the square openings. A smaller substantially ovular opening 164 extends through the base of each recess 162 and is adapted to slidably receive the guide pin 158 of an associated connector cylinder. Accordingly, the connector cylinders 152 are seated within the substantially ovular recesses on the base plate and protrude upwardly into an associated end block on the collar thereby desirably positioning the collar on the base plate.

The operation of the clamp assembly 68 is best illustrated in FIGS. 5 and 6 with FIG. 6 showing the clamp assembly in the open position such that the collar 64 is fully expanded to receive the separator bowl 22. In this position, the inverted U-shaped main body 126 is raised to its maximum extent which as will be seen tilts the main arms 140 of the inverted T-shaped pivot arms 130 toward each other such that the beveled surface 144 of each main arm engages an abutment surface 166 on a central block 168 defined between the slots 138 in the horizontal leg 134 of the main body. As will be appreciated, further effort to raise the main body is blocked by the limited movement of the connector cylinders 152 within the confines of the ovular recesses 162 in which they are disposed as well as by the abutment of the main arms against the central block on the horizontal leg of the main body.

As will also be appreciated, with the main body 126 fully raised as illustrated in FIG. 6, the end blocks 102 of the collar 64 are separated preferably at their normal or at-rest position so that they are not biased in either direction by the spring metal from which the collar is made.

Sliding movement of the main body vertically downwardly, as shown in FIG. 5, tilts the pivot arms 130 so as to cause the main arm 140 of each pivot arm to move away from the central block 168 in the horizontal leg of the main body. As the main body is being depressed, the cross arms of the pivot arms force the associated end blocks 102 of the collar toward each other in a horizontal plane perpendicular to the vertical plane of movement of the main body, thereby retracting the collar or reducing its effective circumference so that it grips the cap 54 of the separator bowl positioned therewithin. Downward vertical movement of the main body of the clamp assembly is terminated when the connector cylinders 152 engage the opposite ends of the ovular recesses 162 in which they are disposed.

As will be appreciated, the connection of the cross arms of the pivot arms to the depending legs 136 of the main body at pivot pins 148 is positioned lower than or beneath the plane of the connection of the cross arms to the connector cylinders 152 at pivot pins 161. This relationship of the connections of the cross arms to both the depending leg 136 of the main body and to the connector cylinder 152 in cooperation with the spring bias of the collar, which urges the ends of the collar away from each other, establishes an overcenter lock that prevents the collar from being released from the fully retracted position.

As will also be appreciated in FIG. 5, when the main body 126 of the clamp assembly 68 is fully depressed, the beveled surfaces 144 of the main arms 140 of the pivot arms are maximally separated. The auxiliary lock plate 132 mentioned previously is a substantially rectangular plate connected by a pivot pin 164 to a sleeve 166 on the upper inner edge of the horizontal leg 134 of the main body. The lock plate can thereby be pivoted from an unlocking radially inwardly directed position, as shown in FIG. 10, to a locking radially outwardly directed position, as shown in FIG. 5. In the radially outwardly directed position of FIG. 5, the auxiliary lock plate lies across the top of the horizontal leg 134 and is disposed between the main arms 140 of each pivot arm thereby preventing the main arms from being moved closer to each other which might otherwise allow the collar 64 to release the separator bowl 22. The auxiliary lock thereby functions as a safety or backup lock to the overcenter lock already established in the assembly. It is further important to note that rotation of the clamp assembly 68 through centrifugal force encourages the auxiliary lock plate arm to remain in its radially outwardly directed locking position.

The housing 67 for the clamping system of the present invention as probably best seen in FIGS. 3 and 10, is of circular configuration and of substantially inverted L-shaped cross-section. The housing is supported upon the base plate 62 so as to overly and substantially enclose the collar 64. The housing is secured to the base plate with suitable fasteners 168 (FIG. 10) and cooperates with the bowl support plate 66 in assuring confinement of the collar adjacent to the base plate.

The housing includes a rectangular slot 170 through which the main body 126 of the clamp assembly protrudes and diametrically opposite that slot, on the top of the housing, a counterweight 172, as seen in FIG. 3, is provided to keep the entire assembly in balance thereby avoiding vibration during operation of the machine.

It will be appreciated from the aforenoted description that a system has been described which not only positively locks a separator bowl within the autotransfusion machine, but does so in a manner such that it is centered about its axis of rotation and includes a pair of backup locking systems to prevent release of the bowl during operation of the machine. The split ring configuration of the collar further allows the system to be utilized with bowls of different sizes and configuration lending versatility to the system.

Although the present invention has been described with a certain degree of particularity, it is understood that the present disclosure has been made by way of example, and changes in detail or structure may be made without departing from the spirit of the invention as defined in the appended claims.

What is claimed is:

1. A system for securing an object of substantially circular cross-section to a rotating plate wherein said object includes a cap around a lower perimeter of larger diameter than the remainder of the object, comprising in combination a split ring collar operatively secured to said rotating plate, said collar being of substantially circular configuration and having two spaced ends and a radially inwardly opening channel adapted to releasably receive said cap, said collar having enough flexibility to be retracted by moving said ends into closely adjacent relationship to reduce the effective circumference of the collar and thereby grip the cap of said object, and a clamp assembly including a lock mounted on said rotating plate, said clamp assembly being operatively connected to said ends of the split collar and being operative to selectively retract said collar to secure said object to said rotating plate.

2. The system of claim 1 wherein said lock is an overcenter lock.

3. The system of claim 2 wherein said lock further includes an auxiliary lock.

4. The system of claim 1 wherein said rotating plate and said collar are configured to cooperate when said collar is retracted to center said object on the rotating plate.

5. The system of claim 4 wherein one of said collar and rotating plate has a cam surface adapted to cooperate with the other of said collar and rotating plate in urging said collar toward the rotating plate as the collar is being retracted.

6. The system of claim 5 wherein one of said collar and object has a cam surface adapted to cooperate with the other of said collar and object in urging said object toward a centered position on the rotating plate when the collar is being retracted.

7. The system of claim 1 wherein one of said collar and object has a cam surface adapted to cooperate with the other of said collar and object in urging said object toward a centered position on the rotating plate when the collar is being retracted.

8. The system of claim 1 wherein said collar has a pair of cam surfaces defined in said channel with one of said cam surfaces adapted to engage said rotating plate when the collar is being retracted to urge the collar toward said rotating plate and the other cam surface is adapted to engage said object when the collar is being retracted to urge the object toward a centered position on the rotating plate.

9. The system of claim 8 wherein said cam surfaces are positioned to simultaneously urge said collar toward said rotating plate and to urge said object toward a centered position on said rotating plate.

10. The system of claim 1 wherein said clamp assembly includes a main frame and a pair of pivot arms connected to said main frame, said pivot arms further being connected to said ends of said collar such that movement of said main frame selectively moves the ends of said collar toward and away from each other causing the collar to move between retracted and expanded positions respectively.

11. The system of claim 10 wherein said main frame is slidably mounted on said rotating plate.

12. The system of claim 11 wherein each of said pivot arms is pivotally connected to said main frame and to one end of said collar.

13. The system of claim 12 wherein said main frame straddles said ends of said collar such that said ends of said collar and said main frame are aligned and wherein said main frame is linearly slidable in a plane perpendicular to said rotating plate.

14. The system of claim 13 wherein said pivot arms are rigid and said pivotal connection of said pivot arms to said main frame and to said ends of said collar cause said ends to move in a place perpendicular to the linear movement of said main frame.

15. The system of claim 14 wherein the ends of said collar, when positioned closely adjacent to each other, are biased away from each other and the connection location of the pivot arms to the main frame moves through the plane of movement of said ends of the collar as said ends are moved toward and away from each other so as to establish an overcenter lock for retaining said collar in the retracted position.

16. The system of claim 15 further including an auxiliary lock plate on said main frame adapted to be moved between said pivot arms when the collar is retracted to thereby block movement of the pivot arms which would otherwise allow said collar to move to its expanded position.

17. The system of claim 10 wherein said main frame includes abutment surfaces against which said pivot arms are adapted to abut to limit pivotal movement of the pivot arms in opposite directions.

* * * * *